United States Patent [19]

Willitts et al.

[11] 4,151,722

[45] May 1, 1979

[54] AUTOMATIC DEFROST CONTROL FOR REFRIGERATION SYSTEMS

[75] Inventors: Benjamin R. Willitts, Trenton; Elmer D. Zickwolf, Bordentown, both of N.J.

[73] Assignee: Emhart Industries, Inc., Hartford, Conn.

[21] Appl. No.: 812,198

[22] Filed: Jul. 1, 1977

Related U.S. Application Data

[63] Continuation of Ser. No. 667,938, Mar. 18, 1976, abandoned, which is a continuation of Ser. No. 600,011, Aug. 4, 1975, abandoned, which is a continuation-in-part of Ser. No. 497,610, Aug. 15, 1974, abandoned, said Ser. No. 667,938 is a continuation-in-part of Ser. No. 626,007, Oct. 28, 1975, abandoned, which is a continuation of said Ser. No. 497,610.

[51] Int. Cl.[2] ..... F25D 21/06

[52] U.S. Cl. ..... 62/155; 62/234; 340/518

[58] Field of Search ..... 62/234, 155, 156, 158, 62/81, 276, 140; 340/518

[56] References Cited

U.S. PATENT DOCUMENTS

| | | | |
|---|---|---|---|
| 2,118,636 | 5/1938 | Alexander et al. | 62/6 |
| 2,433,574 | 12/1947 | Newton | 62/115 |
| 2,666,299 | 1/1954 | Sutton | 62/4 |
| 3,077,747 | 2/1963 | Johnson, Jr. | 62/140 |
| 3,184,926 | 5/1965 | Blake | 62/155 |
| 3,343,375 | 9/1967 | Quick | 62/81 |
| 3,453,837 | 7/1969 | Sandstrom et al. | 62/276 X |
| 3,464,226 | 9/1969 | Kramer | 62/196 |
| 3,633,378 | 1/1972 | Toth | 62/155 X |
| 3,638,444 | 2/1972 | Lindahl | 62/81 |
| 3,664,150 | 5/1972 | Patterson | 62/234 |

FOREIGN PATENT DOCUMENTS

| | | | |
|---|---|---|---|
| 84571 | 9/1953 | Belgium | 62/155 |
| 1263959 | 5/1961 | France | 62/155 |

*Primary Examiner*—William E. Wayner

*Attorney, Agent, or Firm*—Albert Sperry; Frederick A. Zoda; John J. Kane

[57] ABSTRACT

A defrost control scans, in a predetermined sequence, the several evaporators of a refrigeration system of the type that is installed in a supermarket and that typically comprises a series of refrigerated food display cases in which the evaporators are mounted. Individual to each evaporator is a defrosting means and a sensing device that operates to put the defrosting means in a standby, ready-to-operate condition whenever it senses that the evaporator is in need of defrost. When the control means reaches, in the scanning sense, an evaporator whose defrosting means has been placed in a ready-to-operate condition, it acts to initiate actual operation of the defrosting means associated with that evaporator. In these circumstances, the scanning of evaporators that follow in the predetermined sequence is temporarily arrested. This assures against overloading of the defrosting means, which may typically be of the "hot gas" type, and hence particularly sensitive to overloading.

19 Claims, 2 Drawing Figures

AUTOMATIC DEFROST CONTROL FOR REFRIGERATION SYSTEMS

CROSS REFERENCE TO RELATED APPLICATIONS

The present application is a continuation of co-pending U.S. application Ser. No. 667,938 filed Mar. 18, 1976, now abandoned, which application is a continuation of U.S. application Ser. No. 600,011, now abandoned, filed Aug. 4, 1975 as a continuation-in-part of U.S. application Ser. No. 497,610, filed Aug. 15, 1974 and now abandoned. Applicaton Ser. No. 667,938 is also a continuation-in-part of U.S. application Ser. No. 626,007, now abandoned, filed Oct. 28, 1975 as a continuation of application Ser. No. 497,610 now abandoned.

BACKGROUND OF THE INVENTION

1. Field of the Invention

The present invention relates in its most general sense to refrigeration, and more particularly to defrosting controls for the evaporators of refrigerated food display cases. More particularly, the control means constituting the present invention is of the automatic type and is associated with those defrosting means or devices categorized by the industry as "demand defrost" devices, that defrost evaporators only when defrost is actually needed, as distinguished from defrost devices that utilize time clocks and defrost their associated evaporators at predetermined, timed intervals without regard to actual need for defrosting on the part of said evaporators.

2. Description of the Prior Art

Prior to the present invention, it has been common practice in food supermarkets or similar establishments, to utilize, extensively, refrigerated food display cases each of which is provided with its own evaporator (or sets of evaporators), together with means for defrosting said evaporator or sets thereof.

In a typical supermarket installation, there will be a variety of such cases, according to the particular food products that are to be refrigerated and displayed therein. As a result, some of food-retaining areas of the refrigerated display cases are maintained at temperatures distinctly different from the temperatures required for the products-containing areas of other cases. The result is that some of the refrigerated display cases require defrosting more often, than do others installed in the same commercial establishment.

Commonly, the defrost cycles of evaporators of the type described above have been initiated and terminated by means of time clocks such as shown, for example, in U.S. Pat. No. 3,464,226. However, the accumulation of ice and frost on the coils and fins of an evaporator tends to vary markedly from time to time, and from day to day, by reason of sensitivity of the refrigeration system to changes humidity, and the activity of customers in opening or closing doors or reaching into the cases.

The frequency of defrosting operations controlled by a time clock thus may be either more or less than that required for efficient operation of the equipment. This has been long noted by those working in the art, and as a result, various types of defrost control devices have been proposed, that respond not to passage of a predetermined period of time, but rather, to an actual need of the associated evaporator or set of evaporators to be defrosted. These are usually referred to as "demand defrost" controls, typical examples of which are found in U.S. Pat. Nos. 3,282,065; 3,355,904; 3,374,643; 3,464,224; and 3,453,837.

Although demand defrost control devices have been used to advantage in the art, they intrinsically possess characteristics that tend to lessen their desirability as compared to defrost systems utilizing time clocks. The advantages of a demand defrost control system over one utilizing time clocks may be reduced or completely lost, if they result in overloading of the refrigeraton system. If, for example, the system employs electrical defrosting devices individual to the several evaporators or sets of evaporators, excessive demands may be made upon the electrical power circuits involved should a number of the evaporators call for defrost at any one time.

If the defrost system be of the type that utilizes hot gas from a compressor or compressors common to the several evaporators or sets of evaporators, a call for defrost by a number of the evaporators at any one time produces the undesirable result of rendering wholly inadequate the amount of gaseous refrigerant that is returned to the compressor, as well as the supply of liquid refrigerant available to those evaporators that are still operating on a refrigeration cycle.

The state of the art as it existed prior to completion of the present invention, accordingly, may be generally assessed as including, for a series of evaporators or sets thereof, automatic defrost controls utilizing time clocks, which have the advantage of permitting settings that preclude overloading of electrical or hot gas defrost systems at any given time, but which have the disadvantage of initiating defrosting of evaporators whether they need it or not; and on the other hand, defrost controls of the "demand" type, which have the advantage of initiating defrost of evaporators only when defrost is acutally needed, but which have the disadvantage of overloading electrical power circuits or critically affecting the refrigeration cycles of evaporators that do not at the moment require defrost.

SUMMARY OF THE INVENTION

Summarized briefly, the present invention is a control system for commercial refrigeration installations of the type described above, in which all the evaporators (or sets thereof) grouped as components of a single installation, are scanned or checked, so to speak, in a predetermined sequence.

In the disclosed refrigeration system, there is illustrated by way of example a conventional arrangement of a series of evaporators in association with a compressor or compressors. The evaporators, by way of example, are disclosed as being defrosted by reverse flow therethrough of hot gas from the compressors, each evaporator having suitable valve means arranged for producing normal flow of liquid refrigerant therethrough, or reverse flow of hot gas, according to whether the evaporator is to be cooled or, alternatively, defrosted.

Each evaporator is further shown as having in association therewith a sensing device, as for example, a sensor of the type illustrated in Sandstrom U.S. Pat. No. 3,453,837. This senses the need of the associated evaporator for a defrost.

Such a sensing device in association with an evaporator was known and in use prior to completion of the present invention as a control for "demand defrost" installations. Also conventional is the basic arrangement of a series of evaporators in association with a compressor means and a condenser, and with suitable valving, for supplying the evaporators with liquid refrigerant from the compressor means shared by the evaporators in common, and with hot gas from said compressor means for defrosting purposes.

The present invention, thus, provides a defrost control system having the following basic characteristics:

First, individual to the several evaporators of an otherwise conventional refrigerating system are sensors, so arranged as to place in a standby, ready-to-operate condition the defrosting means of the associated evaporators; and Secondly, there is a scanning means, which checks the several evaporators in a predetermined sequence, and upon reaching an evaporator whose defrosting means has been placed in a ready-to-operate condition by the associated sensor, initiates actual operation of said defrosting means, while at the same time arresting further scanning until the defrost cycle ends.

The control system comprising the present invention, thus, makes effective use of the advantages features of demand defrost devices in an assemblage of a series of evaporators with a common compressor and condenser, while eliminating the undesirable features of such devices, as regards overloading of electrical power circuits when electrical defrost means are employed, or preventing effective refrigeration when the defrost means is of the hot gas type.

DESCRIPTION OF THE PREFERRED EMBODIMENT

Figure 1:
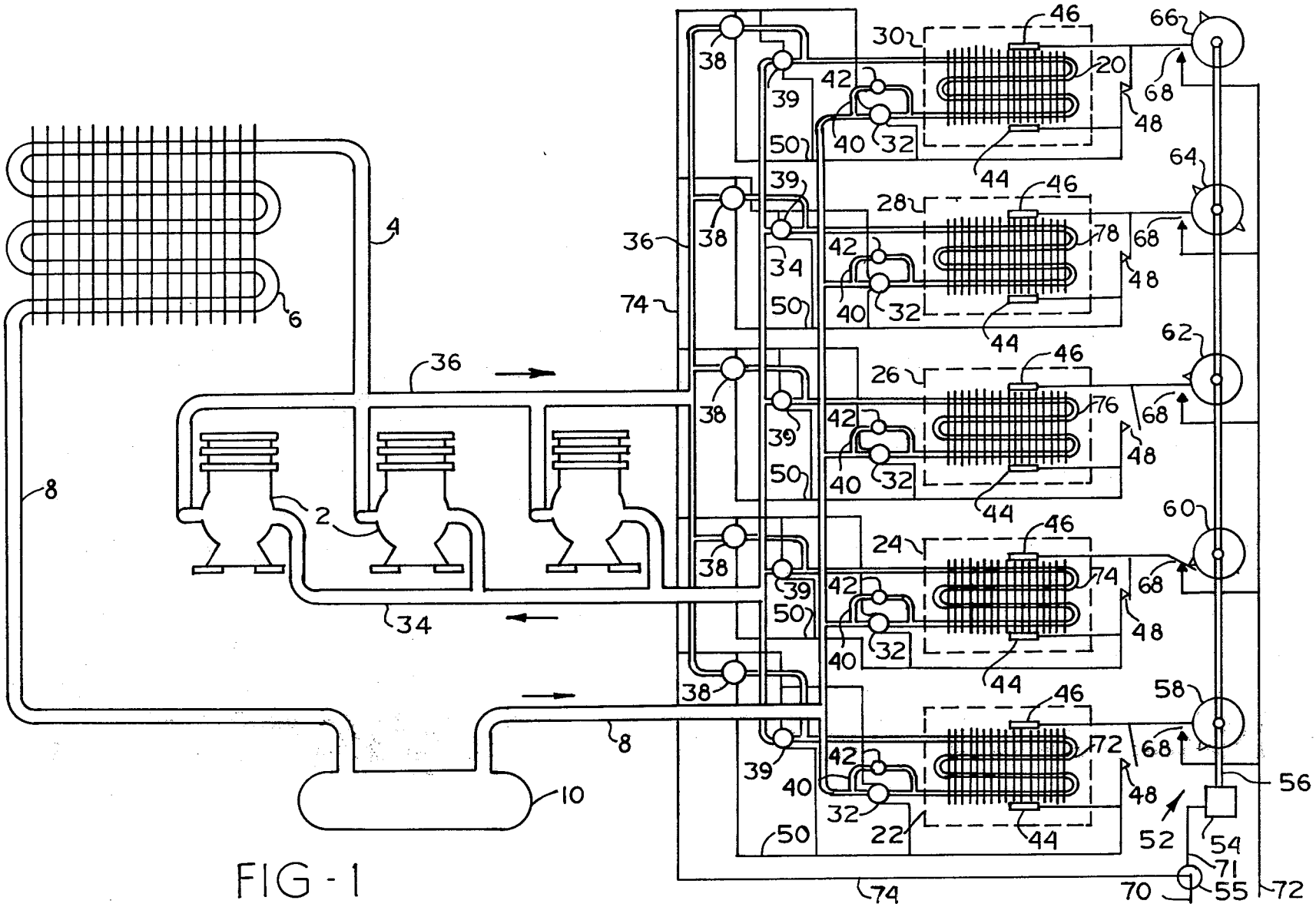
FIG. 1 is a diagrammatic illustration of one embodiment of the present invention.

In FIG. 1, flowing from compressor means 2, through a hot gas line 4, is a compressed gaseous refrigerant, that flows to a condenser 6 from which liquid refrigerant flows through liquid line 8 to a receiver 10 to a series of evaporators 12, 14, 16, 18, and 20 mounted within refrigerated food display cases or fixtures 22, 24, 26, 28, and 30 respectively.

The several fixtures are designed for any of the many different requirements normally found within a food supermarket or the like, and thus may be dairy cases, ice cream and frozen food cases, walk-in or storage cases. Each is provided with its own evaporator, which may consist of one or more coil and fin assemblies, and which is designed to operate at a temperature predetermined as necessary for proper refrigeration of the product stocked in the display case or fixture.

Each evaporator is provided with an expansion valve 32 adjacent the evaporator for admitting liquid refrigerant from liquid line 8 to the evaporator for expansion therein. The vaporized refrigerant from the evaporator returns to the compressor means 2 through a suction line 34.

Each evaporator is provided with means for defrosting the same without requiring defrosting of the other evaporators. The defrosting means could be electrical. However, as shown in the drawing, the evaporators are defrosted by hot gas passed from the compressor means 2 through the evaporator requiring defrost, in a direction that is the reverse of that in which the vaporizing refrigerant passes during the normal refrigerating cycle of the evaporator. In these circumstances, hot refrigerant gas from line 4 is directed through a branched hot gas line 36 to the evaporator that is to be defrosted, by meas of an associated defrosting valve 38 of the solenoid type. Another associated solenoid valve 39 serves to prevent communication between the evaporator and the line 34 during the defrosting cycle. Bypass lines 40, in each of which a check valve 42 is mounted, are provided for permitting such reverse flow of defrosting gas and condensate from the evaporator that is being defrosted, past the expansion valve 32 to the liquid line 8 for flow to the other evaporators for use therein.

It will be understood that during a normal refrigerating cycle, the liquid refrigerant passes in the direction of the arrow shown in FIG. 1 from the receiver 10, through liquid line 8, to any evaporator that is in a refrigerating cycle. When an evaporator is in a refrigerating mode or cycle, its expansion valve 32 is open, for flow of the liquid refrigerant through the coil and fin assembly, the liquid refrigerant entering said assembly at the bottom thereof, viewing the same as in FIG. 1. The flow of refrigerant from the coil and fin assembly is to the associated valve 39, which in these circumstances is open, for return to the compressor means 2 through line 34. The valve 38 of any evaporator that is in a refrigerating cycle is closed at this time.

When a particular evaporator is being defrosted, expansion valve 32 closes, valve 38 opens, and valve 39 closes. These valves would desirably be connected in parallel in a common electrical power circuit. As a result, hot gas flows through line 36 through open valve 38 in a reverse direction through the coil and fin assembly of the evaporator, bypassing closed valve 32 through bypass line 40, the check valve 42 of which opens in a direction to permit the flow through the bypass line. The defrosting gas and condensate enters liquid line 8 in these circumstances, as previously described.

The arrangement so far described in wholly conventional, and does not per se comprise part of the present invention.

Associated with each of the evaporators is a sensing means 44, 46, 48. Said sensing means is illustrated diagrammatically, in its basic essentials in the drawing, but in a preferred, commercial embodiment might be a "demand type" sensor of the kind disclosed in U.S. Pat. No. 3,453,837 to Sandstrom.

Essentially, said means senses the need of the evaporator associated therewith for defrosting, and as illustrated basically includes, for each evaporator, elements 44 and 46 located on the opposite sides of the evaporator. These elements are operable to close contacts 48 associated therewith whenever ice and frost accumulates on the coils and fins of the evaporator to an extend such as will impair the efficiency thereof. Thus, by way of example, the sensing means associated with the evaporators 14, 18, and 20 have responded to the need for defrosting of these particular evaporators, and have, hence, caused their associated contacts 48 to close. In the illustrated example, evaporators 12 and 16 do not require defrosting, and hence their associated sensing means have not acted to close the contacts 48 thereof.

The closing of any set of contacts 48, as a consequence of a sensed need for defrosting of the evaporator associated therewith, closes a circuit through the solenoid valves 38, 39 associated with the same evaporator, through lead 50. In accordance with the invention, however, closing of the contacts 48 of a particular evaporator, for example the evaporator 20, does not energize the solenoid valves 38, 39 of said evaporator 20 responsive solely to closing of the associated contacts 48. Rather, closing of the contacts 48 places the defrosting means associated with evaporator 20 in a standby, ready-to-operate condition, that is, with the contacts 48 of the evaporator 20 now closed, electrical current will be permitted to flow to valves 38, 39 at such time as a control means indicated generally at 52 operates to check or scan the evaporator 20 in a predetermined sequence and finds that its defrosting means has been placed in a standby, ready-to-operate condition.

Thus, in the illustrated example, and still referring to evaporator 20, it may be noted that the sensing means of this evaporator has sensed that it needs defrosting, and has closed contacts 48. However, since a circuit has not been as yet closed from a source of electrical power through contacts 48, lead 50, and solenoid valves 38 and 39, valve 39 remains in its normal open condition, and valve 38 remains closed. Valve 32 is also electrically connected in circuit with valves 38 and 39, and remains in its normal, open condition. As a result, evaporator 20, although its contacts 48 are at this time closed, is still in a refrigerating cycle. Its defrosting means has only been rendered capable of operation, but will not actually go into operation until evaporator 20 is reached, in the scanning sense, by means 52.

Means 52 may as shown embody drive means 54 operable to rotate shaft 56 having cam elements 58, 60, 62, 64, and 66, movable to sequentially close contact elements 68 associated with the several evaporators 12, 14, 16, 18, and 20, respectively.

The cam elements, upon rotation of shaft 56, serve to close the contacts 68 of the various evaporators successively, in a predetermined sequence, to provide an electrical connection with the line 72 of a power circuit. The power circuit for actuating the valves 32, 38, 39 to positions opposite that assumed thereby during normal refrigeration of a particular evaporator will only be completed if the contacts 48 associated with that evaporator have been closed by their associated sensing means 44, 46; and if, with said contacts 48 closed, the contacts 68 associated with the same evaporator are closed by their associated cam elements.

It will be seen, thus, that in the illustrated example, evaporators 12 and 16 are in normal refrigeration cycles, with their valves 32 open, valves 39 open, and valves 38 closed. These evaporators, as seen from the open condition of their contacts 48, do not require defrosting. Any closure of their associated contacts 68 under these conditions would not interrupt their refrigerating cycles. They are, thus, reached and passed during the scanning of the evaporators in the desired, predetermined sequence.

Evaporators 18, 20, as will be noted, do require defrost and this condition has been sensed by their associated sensing means 44, 46, 48, the contacts 48 of these evaporators being closed. These evaporators, however, also remain in a refrigerating mode, with their valves 32 and 39 open and valves 38 thereof closed. This is because they have not been reached in the scanning cycle, so that their associated contacts 68 remain open to prevent power from flowing to the valves 32, 38, 39 of said evaporators 18, 20. The defrosting means of these evaporators has, however, of course been placed in a ready-to-operate condition by closure of their associated contacts 48.

Evaporator 14, however, at this time goes into a defrosting cycle. This is because its sensing means has detected the need for defrosting thereof, and has caused contacts 48 to close. As a consequence, upon reaching of this evaporator in the scanning order, contacts 68 associated therewith are closed. The combination of closed contacts 48 and 68 causes electrical current to flow therethrough through solenoid valves 32, 39, 38 of said evaporator 14, closing valve 32 and valve 39, and opening valve 38. This causes hot gas to flow through evaporator 14 in a reverse direction, as previously described herein.

The drive means 54 by which the cam elements are rotated is de-energized upon closing any one of the contact elements 68 and remains de-energized until the defrosting cycle of the evaporator undergoing defrost has been completed and the contacts 48 associated therewith have been opened. The drive means 54 may be controlled by any suitable or conventional means. Thus, for example, a normally closed relay 55 may be included in drive means power supply line 71 and also be responsive to current flow through line 70 to open the relay and terminate operation of the drive means 54. Current flow through line 70 will exist whenever any evaporator is in the defrost mode and therefore the power line 71 will not be energized whenever a defrost operation is in progress. With this wiring arrangement the continuously running drive source 54 will stop running whenever any evaporator is defrosting.

In this way, the defrosting of other evaporators in the system is prevented and excessive demand for hot gas to be used in defrosting a number of evaporators is precluded. Thereafter, upon conclusion of any defrosting operation, the drive means 54 is again energized and serves to rotate the shaft 56 and cam elements further to complete a circuit for defrosting, in similar fashion, whichever is the next evaporator in the series found to have its associated defrosting means in a ready-to-operate condition.

In this way, the various evaporators in the system may be successively or selectively defrosted as required without danger of drawing off an excessive amount of hot gas from the compressor means or otherwise overloading the system. In practice, when the system embodies say from 12 to 20 fixtures having evaporators supplied with refrigerant from one group of compressor means, it is desirable to arrange the various elements of the combination so as to allow several, but not more than about 30% of the evaporators to be defrosted at any one time. The control means or cam elements of the selector may therefore be arranged and operated accordingly. It will therefore be apparent that the control means may be variously designed to assure the most effective defrosting of the evaporators as required for efficient operation.

Moreover, the evaporators need not be defrosted in strict sequence. Thus, as represented by the cam element 64 associated with evaporator 18 two or more lobes may be provided on the cam to cause an evaporator (an evaporator in an ice cream case, for example, must be maintained at a temperature of about −20° F.) to be defrosted more frequently than the evaporator of a dairy case or the like (which must be maintained at a temperature of about +40° F.). It will, therefore, be apparent that the control means may be designed and programmed to meet priority requirements of any specific installations.

The system thus provided serves to assure effective defrosting of the various evaporators and permits the use of "demand type" or other means for establishing a suitable defrosting cycle for each individual evaporator without danger of overload or excessive demand upon the compressors or other elements of the system.

Figure 2:
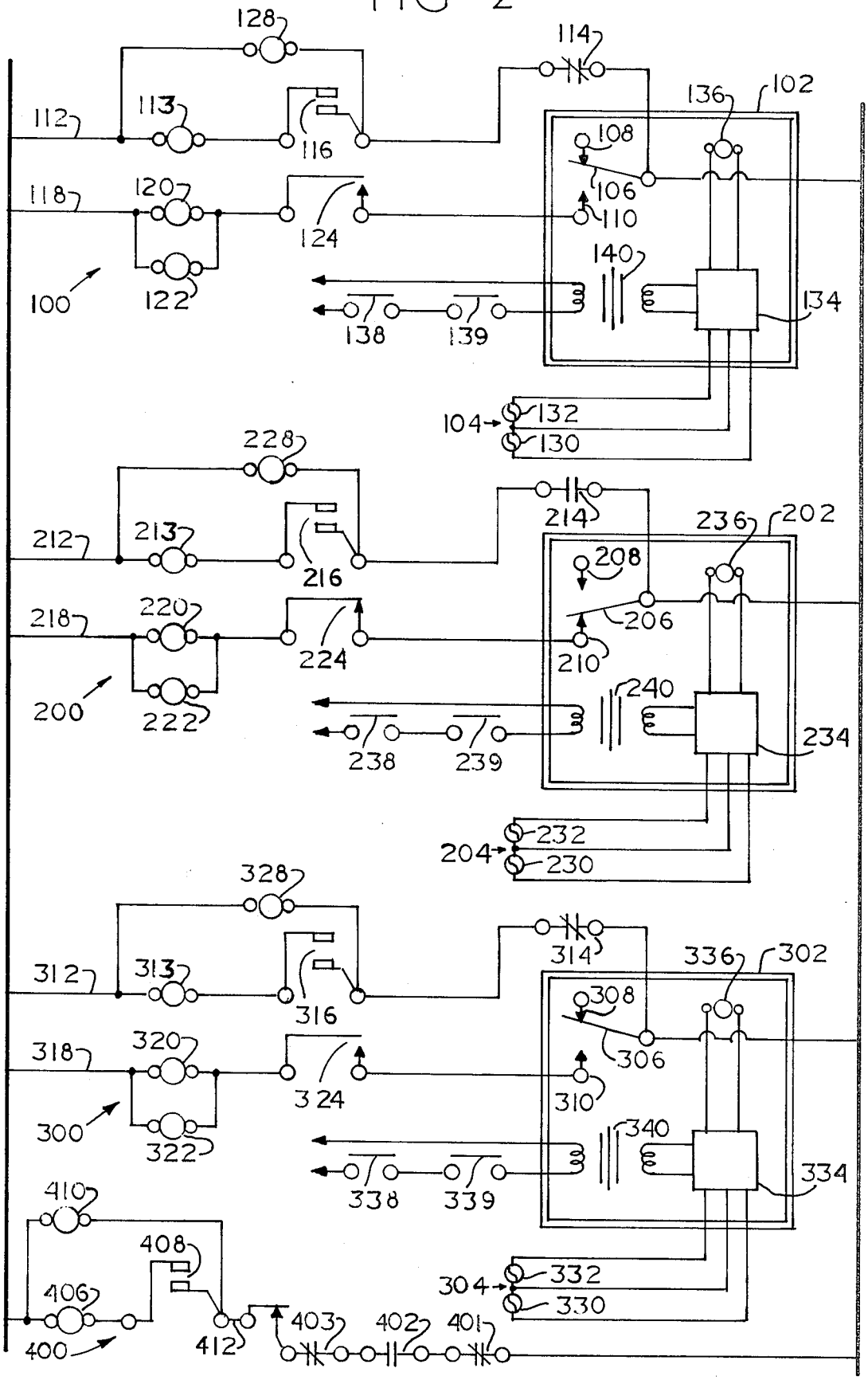
FIG. 2 is a schematic illustration of an electrical circuit.

In FIG. 2, electrical circuitry usable to carry out the present invention is disclosed. Evaporator control circuits 100, 200, 300 are connected in parallel with each other and with a scanning control circuit 400.

Circuits 100, 200, 300 would be used to control the refrigeration and defrosting of, for example, evaporators 16, 18, and 20 of FIG. 1, respectively.

Incorporated as component portions of the respective evaporator control circuits 100, 200, 300 are sensor circuits 102, 202, 302, respectively including sensors 104, 204, 304 each of which, as previously noted, may be constructed as disclosed in U.S. Pat. No. 3,453,837 to Sandstrom. When, for example, the evaporator or set of evaporators controlled by circuit 100 is in a refrigerating cycle, the arm 106 of an evaporator control switch will be in its upper position, in engagement with a refrigerating cycle contact 108 of evaporator control switch represented by arm 106, refrigerating cycle contact 108, and defrosting cycle contact 110.

If, on the other hand, the evaporator or set of evaporators controlled by a circuit 100, 200, or 300 is in a defrosting cycle (in the illustrated example this would be true of the evaporator or set of evaporators controlled by circuit 200), the switch arm would be in its opposite position. Thus, in circuit 200 arm 206 engages defrosting cycle contact 210 rather than refrigerating cycle contact 208.

Since the circuits 100, 200, and 300 are all identical, circuit 300 would similarly include a control switch represented by arm 306, refrigerating cycle contact 308, and defrosting cycle contact 310.

Circuits 100, 200, and 300 respectively include refrigerating circuits 112, 212, 312 and defrosting circuits 118, 218, and 318. In the illustrated example, refrigerating circuit 112 is connected between the opposite sides of the power circuit by switch arm 106 engaging refrigerating cycle contact 108. Circuit 200, however, is illustrated as having its defrosting circuit 218 closed by engagement of switch arm 206 with contact 210.

Incorporated in the refrigerating circuits 112, 212, 312 respectively are pilot solenoids 113, 213, 313, respectively in series with sets of time delay contacts 116, 216, 316 and with normally closed relay contacts 114, 214, and 314.

Connected across the pilot solenoids and their associated time delay contacts, in the respective refrigerating circuits, are the windings of time delay control relays 128, 228, and 328.

The pilot solenoids are conventional, per se, in refrigerating circuits. They are operative, when the associated evaporator or set of evaporators are in their refrigerating cycles. Thus, in circuit 100, wherein the evaporator or evaporators controlled thereby are in the refrigerating cycle, with circuit 112 closed, pilot solenoid 113 allows upstream pressure to communicate with the pilot portion of the evaporator pressure regulator, not shown, permitting it to regulate the temperature within the particular case in which the controlled evaporator or evaporators are mounted.

Thus, assuming that switch arm 106 is thrown to engage refrigerating cycle contact 108, circuit 112 is closed, through normally closed relay contacts 114, energizing relay 128. After a predetermined time delay, the contacts 116 of relay 128 close. This energizes pilot solenoid 113 for initiating the evaporator pressure regulation as described above. A predetermined time delay is known in the art to be important in assuring efficient operation of an evaporator when it returns to its refrigerating mode.

The defrosting circuits 118, 218, 318 respectively include hot gas solenoid valves 120, 220, 320 corresponding to the several valves 38 of FIG. 1. These are in series with normally open scanning contacts 124, 224, 324 of the respective evaporator control circuits 100, 200, 300. The scanning contacts correspond to the several sets of contacts 68 of FIG. 1.

In shunt with valves 120, 220, 320 are the windings of scanning control relays 122, 222, 322 respectively. These act upon contacts 114, 214, 314 respectively. Thus, noting circuit 200 as an example, switch 206, 208, 210 — corresponding to sensing contacts 48 of FIG. 1 — has been operated to place defrosting circuit 218 in a standby, ready-to-operate condition. Closure of circuit 218 for flow of electrical current between the opposite sides of the power circuit does not occur, however, unless and until scanning contacts 224 (corresponding to contacts 68 of FIG. 1) close. Scanning contacts 224 are closed, in the illustrated example, mechanically similarly to the manner in which contacts 68 are closed in FIG. 1.

In any event, circuit 218 has been illustrated as fully closed, due to the closure of contacts 206, 210, and the closure of contacts 224. As a result, hot gas solenoid valve 220, which is normally closed, is energized and hence opens. Simultaneously with opening of valve 220, relay coil 222 is energized. This acts upon normally closed contacts 214 to open the same. Accordingly, upon actual initiation of a defrosting cycle in any evaporator control circuit, resulting from closure of contacts 224 in a situation in which contacts 206, 210 are already in closed position, the refrigerating circuit of that evaporator control circuit is broken by opening of contacts 214, simultaneously with actual initiation of a defrosting cycle due to closure of the defrosting circuit of the same evaporator control circuit. This is the situation illustrated in FIG. 2, as regards evaporator control circuit 200.

Energizing of any of the scanning control relays 122, 222, or 322 resulting from closure of its associated scanning contacts 124, 224, or 324 at a time when its cycle control switch is in the "defrost" position (circuit 200 is illustrated in this condition), results not only in breaking of the companion refrigerating circuit, but also in interruption of scanning of the several evaporator circuits until the defrost cycle is completed.

This occurs by reason of the fact that the relays 122, 222, 322 control relay contacts 401, 402, 403 respectively. These sets of relay contacts are connected in series in the scanning control circuit 400. They are normally closed, but opening of any one of these sets of relay contacts interrupts current to sequencer drive motor 406 connected in series with the drive means control contacts 401, 402, and 403. In the illustrated example, contacts 402, controlled by relay 222, have been opened responsive to energizing of the winding of relay 222. Scanning is accordingly interrupted during defrosting of the evaporator or set of evaporators controlled by evaporator control circuit 200.

Drive motor 406 corresponds to the drive motor 54 of FIG. 1. It is arranged, with respect to the scanning contacts 124, 224, 324 in a manner corresponding to the arrangement seen in FIG. 1 for motor 54, and cam elements 58, 60, 62, 64, and 66, that is, when motor 406 is energized, the several circuits 100, 200, 300 are scanned in a predetermined sequence, closing by cam operation, in said sequence, contacts 124, 224, and 324. It will be apparent that whenever a set of the scanning control is closed, in a defrosting circuit 118, 218, or 318 that has been placed in a ready-to-operate, standby condition by movement of the sensor switch arm to engagement with the defrosting contact 110, 210, or 310 as the case may be, the defrost cycle of the particular, controlled evaporator begins simultaneously with termination of its refrigerating cycle.

It thus follows that in the illustrated example, closure of the contacts 124 by operation of the motor 406 will not terminate the refrigerating cycle of the evaporator or evaporators controlled by circuit 100, because the sensor 104 has not acted to operate arm 106 into engagement with defrosting contact 110. In circuit 200, however, closure of contacts 224 has initiated actual operation of the defrosting means, because the sensor 204 in this instance has previously acted to shift arm 206 into engagement with defrosting contact 210.

It will be understood that connected in parallel with the hot gas solenoid valves 120, 220, and 320 (which as previously noted correspond to the valves 38 of FIG. 1) would be the solenoid valves 32, 39 of the same evaporator control circuit. Valves 120, 220, and 320 have been illustrated purely as schematic representations of any and all solenoid valves that must be energized for the purpose of reversing flow through the particular evaporator or evaporators controlled thereby.

Connected in series with the motor 406 and the motor control contacts 401, 402, 403 is a set of motor control time delay contacts 408 of a motor control relay 410 the winding of which is connected in the scanning control circuit 400 across drive motor 406 and contacts 408.

As previously noted with respect to FIG. 1, the scanning sequence can be altered as desired. If defrost of any one evaporator or set of evaporators should occur, perhaps twice as often as defrost of any of the other evaporators of the system, the sequence can be established to put a priority on this particular evaporator: for example, the sequence could be arranged to close the scanning contacts in a 124, 224, 124, 324, 124, 224, sequence. This is done, in the illustrated example, by appropriate setting of the cam elements 58, 60, 62, 64, 66 shown in FIG. 1.

As previously noted the sensors 104, 204, 304 are already known, per se. In the circuits illustrated by way of example, said sensors respectively include sensing elements 130, 132 of sensor 104; 230, 232 of sensor 204; and 330, 332 of sensor 304. Each pair of sensing elements, as for example the elements 130, 132 correspond to sensing elements 44, 46 of FIG. 1 in respect to function and physical relationship to the evaporator coil.

As disclosed in U.S. Pat. No. 3,453,837, a demand for defrost by the associated evaporator or set of evaporators, sensed by the paired elements, is communicated to solid state control devices 134, 234, 334 of the respective sensors 104, 204, 304. In the illustrated example, in which sensor 204 has responded to a demand for defrost by its associated evaporator or evaporators, control device 234 causes energization of the winding of a cycle control relay 236. The contacts of relay 236 are the refrigerating and defrosting contacts 208, 210. Energizing of the coil of relay 236 operates arm 206 to a position engaging defrosting contact 210. Whenever the winding of relay 236 is in its normal, de-energized condition, arm 206 remains in its upper position, viewed as in FIG. 2, in engagement with refrigerating contact 208.

Similarly in association with the solid state control devices 134 and 334 are the windings of cycle control relays 136, 336 of circuits 100, 300 respectively.

It is thus seen that whenever a requirement for defrost is sensed by one of the sensors, its defrosting circuit is placed in a standby, ready-to-operate condition, and closure of that circuit is thus thereafter permitted to occur when that circuit is reached in the scanning sequence, closing the scanning contacts 124, 224, or 324, as the case may be. Actual initiation of a defrosting cycle occurs when the scanning contacts are closed with the winding of the associated cycle control raly in an energized condition.

In the several evaporator control circuits, there are provided normally closed temperature-sensitive sensor power control switches 138, 238, and 338 respectively. These control the flow of power from a source of electrical power to the primary winding of transformers 140, 240, 340 through which power supplied to the solid state control devices 134, 234, 334 respectively.

Thus, the sensors are normally supplied with power to permit them to function for their intended purpose. Assuming, however, that a particular or set of evaporators is being defrosted (in the illustrated example, this would be true of the evaporator or evaporators controlled by circuit 200), upon completion of the defrosting cycle, temperature-sensitive switch 238 is actuated to open position. As a result, power to the winding of relay 236 is interrupted, so that switch arm 206 reverts to its normal position engaging refrigerating contact 208. This causes solenoid valve 220 (corrsponding to valve 38) to revert to its normal, closed condition. Simultaneously, the associated valves 32, 39 are also de-energized and revert to their normal, open condition to initiate, again, a refrigerating cycle in their associated evaporator or set of evaporators.

The coil of the associated scanning control relays 122, 222, or 322 will also be de-energized. This allows their associated contacts 114, 214, or 314 to revert to their normal, closed position for closure of the refrigerating circuit 112, 212, or 312 as the case may be.

Safety switches 139, 239 and 339 are in series with the switches 138, 238, and 338 respectively, to assure the termination of a defrosting cycle at the appropriate time.

Let it be assumed, by way of example, that in circuit 100, a defrosting cycle has just been completed and relay contacts 114 have reverted to closed position. In these circumstances, power will now be supplied to the time delay control relay 128 thereof. This will in turn act upon the contacts 116, to close the same after a predetermined time delay. This allows water to drain from the evaporator or evaporators controlled by the circuit 100, prior to the actual initiation of the refrigerating cycle. The normal time required for the drain-off varies with the size and orientation of a particular refrigerating system, but normally would be on the order of about seven minutes. Accordingly, after contacts 214 close, the seven minute delay occurs before contacts 116 close. When, eventually, contacts 116 close, pilot solenoid 113 is energized, to restore the actual refrigeration mode of the evaporating controlled by the circuit 100.

At the same time, the resultant de-energization of the winding of relay 122 at the completion of the defrosting cycle will have permitted the associated motor control contacts 401 to close. Assuming that no other evaporator or set of evaporators is in a defrost cycle, all contacts 401, 402, and 403 will in these circumstances be in closed position, permitting power to flow to the winding of motor control relay 410. As previously noted, this relay will maintain contacts 408 in open condition for a predetermined time interval. This interval preferably exceeds, slightly, the time delay established for relays 128, 228, and 328.

This prevents actual initiation of a defrosting cycle of another evaporator prior to reinstitution of a refrigerating cycle for the evaporator, defrosting of which has just been completed. Additionally, the time delay established for relay 410 precludes the possibility of a particular evaporator or set thereof being in a defrosting cycle while another evaporator or set thereof, defrosting of which has just been completed, is still in its time delay period awaiting reinstitution of its refrigerating cycle.

Ultimately, after completion of the predetermined time interval, contacts 408 close, motor 406 is again energized, and the scanning sequence continues.

In certain circumstances, it is desirable to have certain evaporators under demand defrost control, while others in the same overall refrigeration system are defrosted only at fixed intervals, by time clock operation. In this event, a time clock cutout switch 412 may be placed in series with the power supply to motor 406, such that during predetermined time periods, the scanning operation can be halted and a standard time clock defrosting cycle can be initiated for those evaporators that are to be controlled by time clocks rather than by demand defrost means. Again, by interrupting the scanning sequence under these circumstances, overloads are prevented and a predetermined, required minimum number of the evaporators remain in refrigerating cycles. For example, it may be determined that a minimum of 60 percent to 70 percent of the total evaporator load of the system should be in refrigeration at all time, and this is permitted, whether the entire system is controlled by demand defrost means such as shown in FIG. 1, or whether alternatively, some of the evaporators of this system are controlled by demand defrost while others are controlled purely by time clock mechanisms.

With respect to each of the evaporators whose refrigeration and defrosting cycles are controlled in the manner previously described herein, the circuitry used for control purposes may be alternately described as including, in each evaporator control circuit, relay means which in FIG. 1 is designated at 48; and in FIG. 2 is represented by the reference numerals 124, 224, 324 respectively. In FIG. 1, said relay means has what may appropriately be considered as two input circuits, one of which is the circuitry extending thereto from the associated elements 44, 46, the other being the circuitry represented by the branch connection including contacts 68 extending from the common power line 72 of the sequential control means 52. Relay means 48, in FIG. 1, is thus "energized," that is, becomes operative to close a circuit to the hot gas defrost valve 38 when, and only when, each of the input circuits receives input signals.

Further with reference to FIG. 1, the output of each relay means 48, when the input from the associated sensing means 44, 46 and the input from the sequential control means 52 coincide to render said relay means operative as a circuit-closer, is adapted to control the associated valve means 32, 39, 38 for initiating a defrosting cycle in the associated evaporator. Normal operation of the other evaporators is, meanwhile, maintained.

In FIG. 1, it may also be noted that each of the means 48 has a second output circuit designated at 55, 71 to inhibit other outputs on the output circuits of the sequential control means 52 until defrosting of the one evaporator is completed.

Thus, each means 48 may be said to have two outputs, one controlling the valves 32, 38, 39 to initiate a defrosting cycle, and the other comprising the means 55, 71 actuated by means 48 to "lock out" other outputs of the sequential control means 52 until a defrost operation for the one evaporator is completed.

Referring to FIG. 2, this can be alternatively described also, in the sense of having relay means at contacts 124, 224, 324. Considering, by way of example, circuit 100, means 124 has an output at the left thereof, viewing the same as in FIG. 2, to hot gas defrost control valve 120. The means 124, further, is actuated only in response to signals produced by two inputs to said means 124. A first input is shown at 106, 110 in circuit 100, and provides a signal only when sensor elemebts 130, 132 detect the need for defrosting of the associated evaporator and energize the coil of relay 136. A second input to means 124 is provided by the scanning drive motor circuitry, which produces a signal to the means 124 at prescribed intervals during the normal scanning sequence.

Means 124 has a second output resulting from its closed, defrost-initiating position, in the form of the winding of relay 122 energized simultaneously with activation of hot gas solenoid valve 120. The second output is operable to open contacts 401 for the purpose of interrupting flow of power to the drive motor 406, so as to inhibit further scanning by the sequential control means 400.

As used herein, "evaporator" is to be understood as comprehending arrangements wherein there may be a plurality or set of evaporators or evaporator coils connected for joint refrigeration, and incorporated in a complete system along with other, similar sets of evaporators. Thus, evaporator 16 may represent either one evaporator or perhaps a set thereof connected for joint refrigeration or defrost. This might be true, thus, in a single fixture or display case of extended length, in which a number of coils are connected for refrigerating a continuous product-retaining area.

It should also be noted that references in this application to scanning of the evaporators are intended, as is believed apparent from the drawings, description, and claims considered together, in the sense of scanning of the several identical evaporator assemblies or units, five of which are illustrated by way of example in FIG. 1. Each assembly is there seen to include an evaporator coil (or a set of such coils), its associated sensing device, its associated defrosting and refrigeration control valves 32, 38, 39 and 42 together with their electrical circuit connections, and the tubular connections which each coil (or set of coils) has to the rest of the refrigeration system.

We claim:

1. A refrigeration system comprising a plurality of evaporators, defrosting means associated with each of said evaporators, sensing means associated with each of said evaporators operable responsive to need for defrosting to render the defrosting means capable of operation, and control means for selectively initiating the defrosting of those evaporators the defrosting means of which have been rendered capable of operation by said sensing means, said defrosting means utilizing hot refrigerant gas for raising the temperature of the evaporator to defrost the same.

2. A refrigeration system comprising compressor means, condensing means, a plurality of refrigerating fixtures each having an evaporator therein provided with an expansion valve, and means connecting said elements in a closed cycle to refrigerate said fixtures, means associated with each of said evaporators for defrosting the same, sensing means responsive to a frosted condition of the evaporator with which it is associated for rendering said defrosting means capable of operation, and control means for selectively initiating the operation of those defrosting means which have been rendered capable of operation by said sensing means, said defrosting means including mechanism for supplying hot refrigerant gas from said compressor to the evaporators to defrost the same.

3. A refrigeration system comprising compressor means, condensing means, a plurality of refrigerating fixtures each having an evaporator therein provided with an expansion valve, and means connecting said elements in a closed cycle to refrigerate said fixtures, means associated with each of said evaporators for defrosting the same, sensing means responsive to a frosted condition of the evaporator with which it is associated for rendering said defrosting means capable of operation, and control means for selectively initiating the operation of those defrosting means which have been rendered capable of operation by said sensing means, said control means being operable to permit a portion only of said evaporators to undergo defrosting at any one time.

4. The method of defrosting a series of evaporators in a refrigeration system each of which evaporators is provided with its own defrosting means utilizing hot gas from a compressor means incorporated in said system, which comprises the steps of rendering each defrosting means capable of operation in response to the evaporator's need for defrosting, and selectively actuating those defrosting means that have been rendered capable of operation to permit only some of said evaporators to be defrosted at any one time, said defrosting means being operable to control the flow of hot refrigerant gas from said compressor means to said evaporators during defrosting the evaporators.

5. An improved automatic defrost control for a refrigeration system having a plurality of evaporators, means for defrosting the evaporators, and sensing means individual to the several evaporators and adapted to ready the defrosting means for operation as to those evaporators sensed as requiring defrost, wherein the improvement comprises means for scanning all of said evaporators in a predetermined sequence and for initiating actual operation of the defrosting means previously readied for operation, to defrost in said sequence the evaporators sensed as requiring defrosting, and means for interrupting said scanning during the defrosting of at least one of the evaporators.

6. An improved automatic defrost control for a refrigeration system having a plurality of evaporators, means for defrosting the evaporators, and sensing means individual to the several evaporators and adapted to ready the defrosting means for operation as to those evaporators sensed as requiring defrost, wherein the improvement comprises means for scanning all of said evaporators in a predetermined sequence and for initiating actual operation of the defrosting means previously readied for operation, to defrost in said sequence the evaporators sensed as requiring defrosting; first contacts individual to the respective evaporators and actuable by the sensing means to ready the defrosting means for operation; and second contacts also individual to the respective evaporators and actuable by the scanning means to connect to a source of power, and thereby fully activate, the defrosting means that have been made ready for operation, said defrosting means being electrically controlled for activation of the same responsive to connection thereof to a source of electrical power, said first and second contacts being connected between the defrosting means and said source in a circuit configuration such that flow of power sufficient to fully activate the defrosting means is permitted only when both the first and second contacts are actuated.

7. An improved automatic control for refrigeration systems as in claim 6 wherein said first and second contacts are normally open, and are actuated to a closed position by the sensing means and scanning means respectively to close a power circuit between said source of power and the defrosting means.

8. An improved automatic control for refrigeration systems as in claim 7 wherein the first and second contacts are connected in series in said power circuit.

9. An improved automatic control for refrigeration systems as in claim 8 wherein the means for temporarily disconnecting the motor means from said source of power includes relay means operable by actuation of the first and second contacts and adapted, when so operated, to interrupt the connection between said motor means and the source of power.

10. An improved automatic defrost control for a refrigeration system having a plurality of evaporators, means for defrosting evaporators, and sensing means individual to the several evaporators and adapted to ready the defrosting means for operation as to those evaporators sensed as requiring defrost, wherein the improvement comprises means for scanning all of said evaporators in a predetermined sequence and for initiating actual operation of the defrosting means previously readied for operation, to defrost in said sequence the evaporators sensed as requiring defrosting; first contacts individual to the respective evaporators and actuable by the sensing means to ready the defrosting means for operation; and second contacts also individual to the respective evaporators and actuable by the scanning means to connect to a source of power, and thereby fully activate, the defrosting means that have been made ready for operation, said scanning means including electrically driven motor means operative to actuate the second contacts in said sequence and having a connection to said source of power; and means responsive to actuation of the first and second contacts for temporarily disconnecting the motor means from the source of power to interrupt normal operation of the scanning means during the defrosting of at least one of said evaporators.

11. An improved automatic defrost control for a refrigeration system having a plurality of evaporators, means for defrosting the evaporators, and sensing means individual to the several evaporators and adapted to ready the defrosting means for operation as to those evaporators sensed as requiring defrost, wherein the improvement comprises means for scanning all of said evaporators in a predetermined sequence and for initiating actual operation of the defrosting means previously readied for operation, to defrost in said sequence the evaporators sensed as requiring defrosting; first contacts individual to the respective evaporators and actuable by the sensing means to ready the defrosting means for operation; second contacts also individual to the respective evaporators and actuable by the scanning means to connect to a source of power, and thereby fully activate, the defrosting means that have been made ready for operation; and means responsive to defrost at least one of said evaporators for interrupting operation of the scanning means until said defrost is completed.

12. An improved automatic defrost control for a refrigeration system of the type having a plurality of evaporators, normally inactive means for defrosting the same, and means to sense in each evaporator a requirement for defrost, wherein the improvement comprises: first and second signal means associated with each evaporator and controlling operation of said defrosting means with respect to their associated evaporator, the actuation of both signal means associated with an evaporator being required in order to activate the defrosting means for defrosting of that evaporator, said sensing means actuating the first signal means in response to sensing of a requirement for defrost of the associated evaporator; scanning means actuating the second signal means of the several evaporators in a predetermined sequence, whereby to defrost, in that sequence, those evaporators that have been sensed as requiring defrost; means responding to actuation of associated first and second signal means to stop operation of the scanning means on initiation of the defrost of at least one of said evaporators; and means responding to completion of said defrost to return the scanning means to normal operation.

13. An improved automatic defrost control as in claim 12 wherein the means for returning the scanning means to normal operation is of the temperature-sensitive type.

14. An improved automatic defrost control for a refrigeration system having a plurality of evaporators, a condenser from which liquid refrigerant flows to the several evaporators, a compressor from which compressed gaseous refrigerant flows to the condenser, a hot gas line extending from the compressor to the evaporators, means for sensing a need for defrost in each of said evaporators, and a normally closed solenoid valve for each evaporator from said line for defrosting purposes, wherein the improvement comprises, for each valve, first and second contacts both of which must be actuated to operate their associated valve to open position for admitting said hot gaseous refrigerant to the associated evaporator for defrosting purposes, the sensing means actuating the first contacts whenever the evaporator associated therewith requires defrosting; and scanning means actuating the second contacts each time said associated evaporator is reached in the predetermined scanning sequence, for opening of said hot-gas-admitting valve when and only when the evaporator associated therewith requires defrost and has been reached in the order in which the several evaporators are being scanned.

15. An improved automatic defrost control as in claim 14 wherein said first and second contacts are connected between their associated valve and a source of electrical power, said first and contacts being arranged to close a circuit between the valve and the power source, to open the valve, only at such times as the scanning means actuates the second contacts following actuation of the first contacts by the sensing means.

16. An improved automatic control as in claim 15 wherein the first and second contacts are in series between the valve and said source of power and are normally open.

17. In a refrigeration system comprising compressor means, a condenser and a plurality of evaporators connected in parallel in a closed circuit with said compressor means and condenser, a valve associated with each evaporator operable to cause hot refrigerant gas to be passed from said compressor means to the evaporator to defrost the same, a separate electrical circuit for actuating each of said valves, each of said circuits including a first switch, sensor means associated with each evaporator operable to cause said first switch to be closed upon the accumulation of a predetermined amount of frost on the evaporator, a second switch connected in series with said first switch to complete a circuit for actuating said valve when both said switches are closed, and motor driven means for successively closing the second switch of each of said circuits to successively defrost those evaporators having a predetermined amount of frost thereon.

18. A refrigeration system as defined in claim 17 wherein said motor driven means includes elements operable to close the second switches of said circuits in a programmed sequence.

19. A refrigeration system as defined in claim 17 wherein said motor driven means includes a shaft having cam elements thereon arranged to close the second switches in said circuits in a predetermined sequence.

* * * * *

UNITED STATES PATENT AND TRADEMARK OFFICE

CERTIFICATE OF CORRECTION

PATENT NO. : 4,151,722

DATED : May 1, 1979

INVENTOR(S) : Benjamin R. Willitts and Elmer D. Zickwolf

It is certified that error appears in the above-identified patent and that said Letters Patent are hereby corrected as shown below:

Column 11, line 40, change "time" to --times--.

Column 12, line 22, change "elemebts" to --elements--.

Signed and Sealed this

*Nineteenth* Day of *August 1980*

[SEAL]

*Attest:*

SIDNEY A. DIAMOND

*Attesting Officer*

*Commissioner of Patents and Trademarks*